US007336199B2

(12) United States Patent
Lasater et al.

(10) Patent No.: US 7,336,199 B2
(45) Date of Patent: Feb. 26, 2008

(54) INDUCTIVE COUPLING SYSTEM

(75) Inventors: Jeffrey B. Lasater, Houston, TX (US); Ronald G. Earles, Houston, TX (US); John R. Hardin, Houston, TX (US); Imran Vehra, Houston, TX (US); Randal T. Beste, Houston, TX (US); Sergei Sharonov, Houston, TX (US); Michael W. Holcombe, Houston, TX (US); Mark A. Sitka, Houston, TX (US); Richard T. Hay, Houston, TX (US)

(73) Assignee: Halliburton Energy Services, Inc, Houston, TX (US)

( * ) Notice: Subject to any disclaimer, the term of this patent is extended or adjusted under 35 U.S.C. 154(b) by 91 days.

(21) Appl. No.: 11/380,715

(22) Filed: Apr. 28, 2006

(65) Prior Publication Data

US 2007/0257812 A1 Nov. 8, 2007

(51) Int. Cl.
*G01V 3/00* (2006.01)

(52) U.S. Cl. ..... 340/854.8; 340/854.4; 340/853.1; 439/194

(58) Field of Classification Search ..... 340/854.8, 340/854.4, 853.3, 853.1, 853.7; 439/194; 175/61, 73
See application file for complete search history.

(56) References Cited

U.S. PATENT DOCUMENTS

| | | | |
|---|---|---|---|
| 2,370,818 | A | 3/1945 | Silverman |
| 2,379,800 | A | 7/1945 | Hare |
| 2,414,719 | A | 1/1947 | Cloud |
| 3,090,031 | A | 5/1963 | Lord |
| 3,209,323 | A | 9/1965 | Grossman, Jr. |
| 4,544,035 | A | 10/1985 | Voss |
| 4,605,268 | A | 8/1986 | Meador |
| 4,725,837 | A | 2/1988 | Rubin |
| 4,736,204 | A | 4/1988 | Davison |
| 4,788,544 | A | 11/1988 | Howard |
| 4,806,928 | A | 2/1989 | Veneruso |
| 4,838,797 | A | 6/1989 | Dodier |
| 4,901,069 | A | 2/1990 | Veneruso |

(Continued)

OTHER PUBLICATIONS

Fay, J.B., et al., "Wired Pipes for a High-Data-Rate MWD System," European Petroleum Conference, Nov. 16-18, 1992, p. 95-104, SPE 24971, Society of Petroleum Engineers Inc., Cannes, France.

(Continued)

*Primary Examiner*—Albert K. Wong
(74) *Attorney, Agent, or Firm*—Conley Rose, P.C.

(57) ABSTRACT

An inductive coupling system including a mandrel and an inner sleeve and outer housing that surround and rotate relative to the mandrel. The system also includes a mandrel electronics system and a housing electronics system that communicate electronically using a mandrel inductive coupler and a housing inductive coupler. The mandrel electronics system may also communicate with equipment on the surface. Alternatively, the system may include a mandrel and first and second mandrel electronics systems in different mandrel sections. The first and second mandrel electronics systems communicate electronically using a mandrel inductive coupler. Also alternatively, the system may include a mandrel and an inner sleeve and outer housing that surround and rotate relative to the mandrel. The system also includes a mandrel electronics system and a housing electronics system that communicate electronically using a housing inductive coupler.

32 Claims, 9 Drawing Sheets

U.S. PATENT DOCUMENTS

| | | | |
|---|---|---|---|
| 5,052,941 | A | 10/1991 | Hernandez-Marti et al. |
| 5,278,550 | A | 1/1994 | Rhein-Knudsen et al. |
| 5,455,573 | A | 10/1995 | Delatorre |
| 5,979,570 | A | 11/1999 | McLoughlin et al. |
| 6,160,492 | A | 12/2000 | Herman |
| 6,244,361 | B1 | 6/2001 | Comeau et al. |
| 6,340,063 | B1 | 1/2002 | Comeau et al. |
| 6,415,878 | B1 | 7/2002 | Cargill et al. |
| 6,427,783 | B2 | 8/2002 | Krueger et al. |
| 6,581,699 | B1 | 6/2003 | Chen et al. |
| 6,640,909 | B2 | 11/2003 | Vandenberg et al. |
| 6,641,434 | B2 | 11/2003 | Boyle et al. |
| 6,670,880 | B1 | 12/2003 | Hall et al. |
| 6,684,952 | B2 | 2/2004 | Brockman et al. |
| 6,717,501 | B2 | 4/2004 | Hall et al. |
| 6,808,027 | B2 | 10/2004 | McLoughlin et al. |
| 6,888,473 | B1 | 5/2005 | Hall et al. |
| 2005/0074998 | A1 | 4/2005 | Hall et al. |
| 2006/0073722 | A1* | 4/2006 | Allan ..... 439/246 |

OTHER PUBLICATIONS

Jellison, M.J., et al., "Telemetry Drill Pipe: Enabling Technology for the Downhole Internet," IADS/SPE Drilling Conference, Feb. 19-21, 2003, p. 1-10, SPE 79885, Society of Petroleum Engineers Inc., Amsterdam, The Netherlands.

* cited by examiner

INDUCTIVE COUPLING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

When drilling a well, a drill operator often wishes to deviate a wellbore or control its direction to a given point within a producing formation. This operation is known as directional drilling. One example of this is for a water injection well in an oil field that is generally positioned at the edges of the field and at a low point in that field (or formation).

To deviate a bore hole left or right, the driller may choose from a series of special downhole tools such as downhole motors, so-called "bent subs", and steerable motors. A bent sub is a short tubular that has a slight bend to one side, is attached to the drill string, followed by a survey instrument, of which an MWD tool (Measurement While Drilling) is one generic type, followed by a downhole motor attached to the drill bit. The drill is lowered into the wellbore and rotated until the MWD tool indicates that the leading edge of the drill bit is facing in the desired direction. Weight is applied to the bit through drill collars and, by pumping drilling fluid through the drill string, the downhole motor rotates the bit.

The downhole tools communicate with equipment and controls on the surface through any suitable type of telemetry/receiver system that may both send and receive data. The telemetry/receiver system may be incorporated into the MWD tool or be a stand-alone system. Examples of such telemetry/receiver systems include wireline systems, steering tool systems, electromagnetic systems, e-line systems for pipe or coiled tubing, acoustic systems, so-called "wired pipe" systems where electric conduits are located in or in portions of the wall of the drill string, casing, or liner such as the INTELLIPIPE® by GRANT PRIDECO™, or wired composite pipe as such as the ANACONDA® by HALLIBURTON™, and mud-pulse systems where the fluid pressure in the borehole is modulated to transmit and receive data.

In addition to controlling the required drilling direction, the formation through which a wellbore is drilled exerts a variable force on the drill string at all times. This along with the particular configuration of the drill can cause the drill bit to wander up, down, right, or left. The industrial term given to this effect is "bit-walk". The effect of bit-walk in a vertical hole can be controlled, by varying the weight on the bit of the drillstring while drilling a vertical hole. However, in a highly inclined or horizontal well, bit-walk becomes a major problem. An issue with information time delay also exists. The downhole tools used to control the drilling direction may include survey instruments attached a certain distance away from the drill bit itself, sometime by as much as thirty to forth feet. Thus, by the time the survey instruments pass the point in the wellbore where the drill bit began to change direction, the drill bit is another thirty to forty feet ahead and may have changed direction even more. Thus, there is a constant issue of inherently outdated information.

If changes in the forces that cause bit-walk occur while drilling, some tools must be withdrawn in order to correct the direction of the wellbore. The absolute requirement for tool withdrawal requires that a round trip be performed. This results in a compromise of safety and a large expenditure of time and money.

One type of drilling tool system is a rotary steerable tool (RST) that selectively controls the direction of a well bore but does not generally require withdrawal over a much broader range of changes in force that would otherwise affect the steering of the wellbore drilling with normal rotary hook up BHA assemblies. One example of an RST tool shown in FIG. 1 comprises a mandrel rotatable about a rotation axis. The rotating mandrel is used to transfer the rotary motion of the drill pipe to the drill bit and acts as continuation conduit of the drill pipe for all drilling fluids passing down the drill pipe and onto the drill bit. The system also includes a direction controller including at least an outer housing and an inner sleeve spaced apart along the mandrel. The outer housing and inner sleeve apply a force to the mandrel with a component perpendicular to the rotation axis that depends on the relative rotational position of the outer housing and the inner sleeve with respect to the mandrel. The housing has an eccentric longitudinal bore that forms a weighted side that freely rotates under gravity. The inner sleeve may also include an eccentric longitudinal bore. The apparatus also includes a driver for selectively varying the angle of the force relative to the weighted side of the housing about the rotation axis by moving the outer housing and inner sleeve independently of one another.

In operation, the driver moves the direction of the force with respect to the outer housing. A means instructs the driver to move the position of the direction of application of the force on the mandrel. Therefore, the system may further include logic means for determining when the direction of the force applied by the direction controller should be moved. The logic means may be located in the outer housing and may be configured to send and/or receive data from the surface. To communicate with the surface, the logic means may communicate with a telemetry system that is part of the bottom-hole-assembly (BHA) that in turn communicates with the surface. The communications link must allow for the relative rotation between the outer housing, the inner sleeve, and the rotating mandrel.

During assembly of the RST tool shown in FIG. 1, a sonde must be picked up to stab into and connect with the RST tool for communication. The bHA may be long and difficult to get precise distance measurements typically required for a standard electrical connection across a tool joint. For example, debris in the hang off sub may create a stand off in the expected distances as the flow tube lands on the debris instead of on the intended shoulder. Furthermore, the electrical connection can become flooded with fluid as the sonde is being lowered or raised from its position in the drill collar, creating a potential for failure via electrical shorting.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
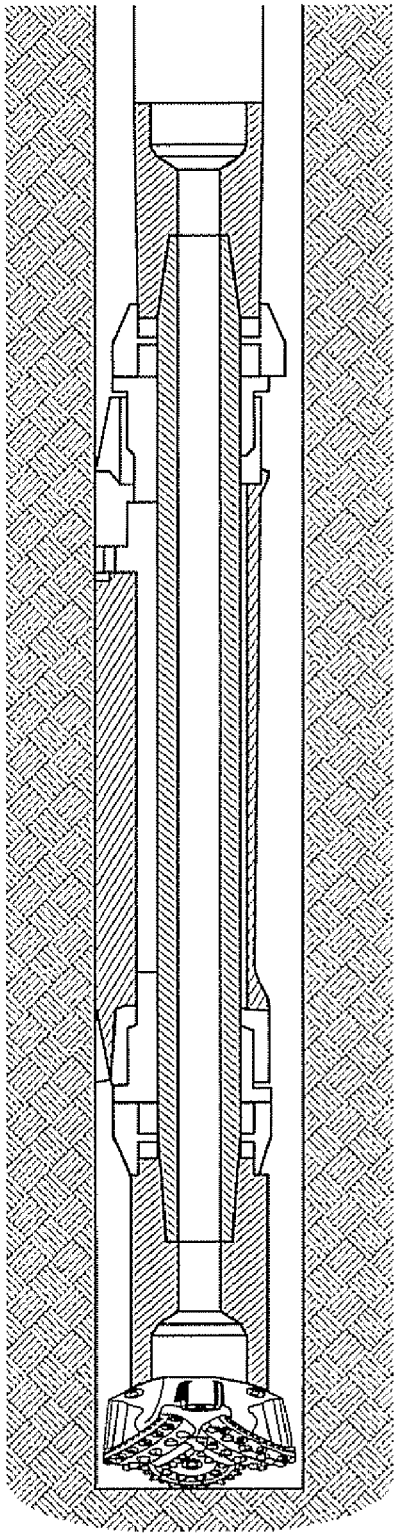
FIG. 1 (Prior Art)
FIG. 1 is a cross section of an example of a RST tool.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
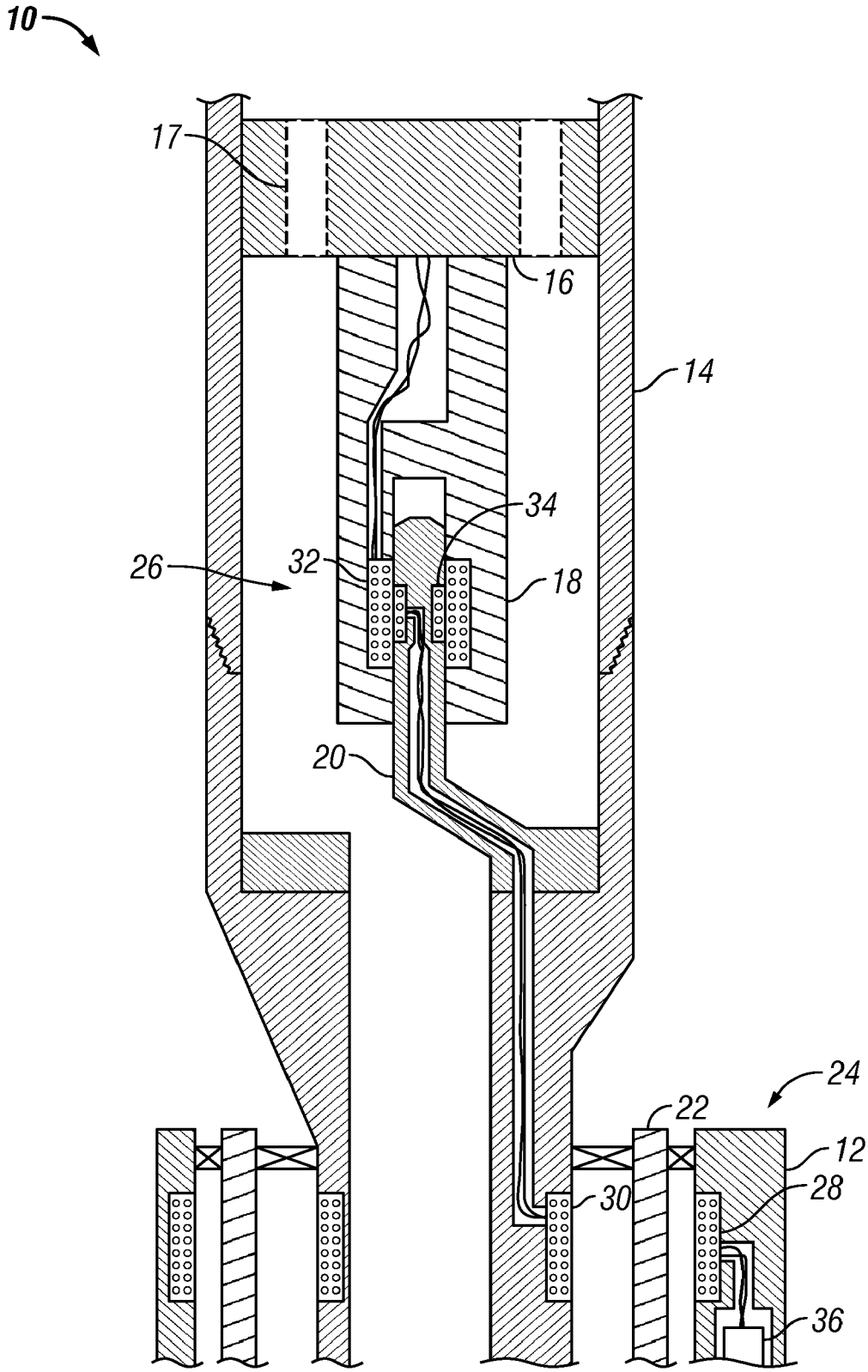
FIG. 2 is a cross section of the inductive coupling system.
Figure 3:
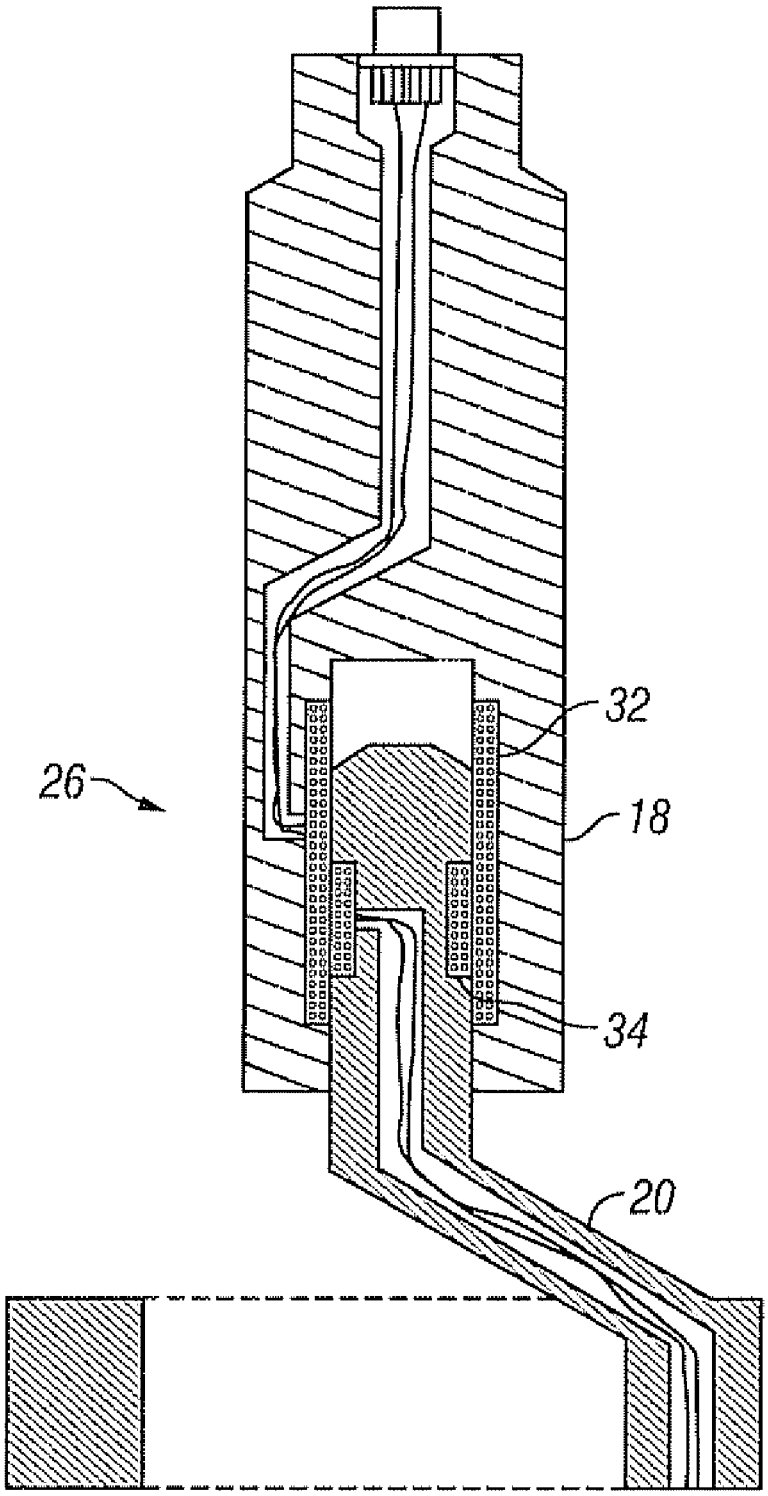
FIG. 3 is cross section of the mandrel inductive coupler of the inductive coupling system.
Figure 4:
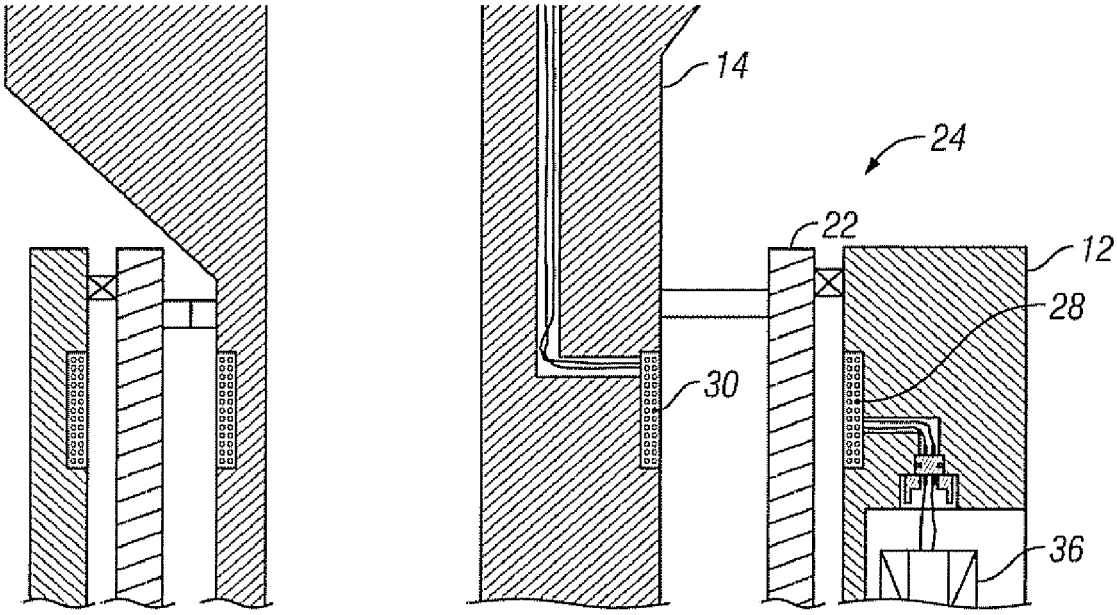
FIG. 4 is a cross section of the housing inductive coupler of the inductive coupling system.

FIGS. 2, 3 and 4 illustrate an electromagnetic inductive coupling system 10 for a mandrel 14 that has a wall and an inner bore. For example, as illustrated in this embodiment, the mandrel 14 may be part of the RST system described with reference to FIG. 1. The inductive coupling system 10 also includes an inner sleeve 22 and an outer housing 12. As illustrated, the mandrel 14 is in the form of a portion of a drill string used in a wellbore, and may itself comprise multiple pipe sections. As such, attached at the lower end of the mandrel 14 is a drill bit for boring into a formation. However, other applications for rotating mandrels are within the scope of this system. Located within the inner bore of the mandrel 14 is a mandrel electronics system 16. The mandrel electronics system 16 may be any electronics system, for example a communications device and/or a power source or load. The mandrel electronics system 16 may also include a telemetry/receiver system that may either be a stand-alone system or incorporated into a MWD system. Examples of telemetry/receiver systems include, but are not limited to, wireline systems, steering tool systems, electromagnetic systems, e-line systems for pipe or coiled tubing, acoustic systems, so-called "wired pipe" systems where electric conduits are located in the wall of the drill string, casing, or liner such as the INTELLIPIPE® by GRANT PRIDECO™, or wired composite pie as such as the ANACONDA® by HALLIBURTON™, and mud-pulse systems where the fluid pressure in the borehole is modulated to transmit and receive data. The mandrel electronics system 16 further includes ports 17 allowing the flow of drilling fluid in the inner bore of the mandrel 14 through the mandrel electronics system 16. If the mandrel electronics system 16 is incorporated into a MWD system, the MWD system may comprise any suitable tools for measuring various data while drilling. Examples include sensors for measuring porosity and resistivity of the formation being drilled through. Other sensors may measure the status of the mandrel 14 or performance operations of the drilling process. The mandrel electronics system 16 also includes a communications port 18 extending into the inner bore of the mandrel 14.

The inductive coupling system 10 also includes a communication probe 20 extending from the wall of the mandrel 14 into the mandrel inner bore. As illustrated, the communication probe 20 is separate from the mandrel 14 and attached by any suitable means such as a threaded connection. However, the communication probe 20 may also be made integral with the mandrel 14.

As illustrated in FIG. 4, the inductive coupling system 10 also includes an inner sleeve 22 including a bore surrounding at least a portion of the mandrel 14. The inner sleeve 22 is rotatable relative to the mandrel 14. As an example, the inner sleeve 22 may rotate on bearings between the mandrel 14 and the inner sleeve 22. As an alternative, the inner sleeve bore may be eccentrically positioned with respect to the rotatinoal axis of the mandrel 14. It should also be appreciated, however, that the inner sleeve 22 need not rotate with respect to the mandrel 14 during operation of the inductive coupling system 10. As illustrated in FIG. 4, there is a gap between the inner sleeve 22 and the mandrel 14. This space may be occupied by conductive or non-conductive fluids, a gas, or a vacuum of essentially empty space.

The inductive coupling system 10 also includes an outer housing 12 that includes a bore surrounding at least a portion of the inner sleeve 22. The outer housing 12 is rotatable relative to the inner sleeve 22 and thus also the mandrel 14. As an example, the outer housing 12 may rotate on bearings between the outer housing 12 and the inner sleeve 22. As an alternative, the outer housing bore may be eccentric with respect to the rotational axis of the mandrel 14. It should also be appreciated, however, that the outer housing 12 need not rotate with respect to the mandrel 14 during operation of the inductive coupling system 10. As illustrated in FIG. 4, there is a gap between the outer housing 12 and the inner sleeve 22. This space may be occupied by conductive or non-conductive fluids, a gas, or a vacuum of essentially empty space.

The inductive coupling system 10 also includes a housing inductive coupler 24 and a mandrel inductive coupler 26. The housing inductive coupler 24 includes a housing outer coil 28 that is a solenoid wound inductive coil located in and moving with the outer housing 12. The housing outer coil 28 is in electric communication with the housing electronics system 36. The housing inductive coupler 24 also includes a housing inner coil 30 that is a solenoid wound inductive coil located in and moving with the mandrel 14. As illustrated in FIGS. 1 and 3, the inner sleeve 22 is located between the housing inner coil 30 and the housing outer coil 28. The inner sleeve 22 may be of any suitable material that would allow the electromagnetic communication between the housing outer coil 28 and the housing inner coil 30. For example, the inner sleeve 22 may be made of metal, even though some attenuation of the electro-magnetic field communicated between the housing outer coil 28 and the housing inner coil 30 may occur. The inner sleeve 22 may also be non-conductive, such as composite tubing or various plastics. Additionally, either of or both of the inner sleeve 22 and the outer housing 12 may have eccentric bores with respect to the mandrel 14. If so, the radial distance between the housing outer coil 28 and the housing inner coil 30 in plane will vary with the rotational orientation of the inner sleeve 22 and outer housing 12 with respect to the mandrel. Additionally, the housing outer coil 28 is in electric communication with a housing electronics system 36 located in the wall of the outer housing 12 though suitable electric conduits running through the wall of the outer housing 12. For example, the conduits may be electrical wiring that may be insulated or potted for protection. Additionally, the housing electronics system 36 may also further be connected to other electronics systems or sensors in other parts of the mandrel 14. Additionally, the inductive coils may be located in sleeves separate from the mandrel 14 and the outer housing 12.

The mandrel inductive coupler 26 includes a mandrel coil 32 that is a solenoid wound inductive coil located in the communications port 18 of the mandrel electronics system 16. The mandrel coil 32 is in electric communication with the mandrel electronics system 16 through suitable electric conduits running through the communications port 18. The mandrel inductive coupler 26 also includes a probe coil 34 that is a solenoid wound inductive coil located in the communication probe 20. Additionally, the probe coil 34 is in electric communication with the housing inner coil 30 through suitable electric conduits that run through the communication probe 18 and the wall of the mandrel 14. The communications port 18 and communication probe 20 may be made out of any suitable material. However, to increase the strength or power of the communication through the mandrel inductive coupler 26, either or both the communications port 18 and communication probe 20 may be made out of a ferrous material.

The mandrel inductive coupler 26 may also be alternatively configured. As illustrated in FIG. 2, the mandrel coil 32 is longer than the probe coil 34. This allows inductive communication through the mandrel inductive coupler 26 without requiring a precision match up of the location of the mandrel coil 32 with respect to the probe coil 34 upon the assembly of the inductive coupling system 10 by inserting the communication probe 20 into the communications port 18. However, it should also be appreciated that the probe coil 34 may be longer than the mandrel coil 32. It should also be appreciated that the mandrel coil 32 and probe coil 34 may be of equal length. It should also be noted that even if the mandrel coil 32 and probe coil 34 are of equal length, they need not match up exactly upon full assembly to allow the inductive coupling assembly 10 to operate. Thus, some "play" is allowed for cut backs and tape measurement tolerances. Although FIG. 2 illustrates the communication port 18 as being an open-ended, or "female" connector and the communications probe 20 as being a closed, or "male" connector. However, it should be appreciated that the male/female communication may be reversed such that the communications probe 20 would be the "female" connector and the communications port 18 would be the "male" connector.

FIGS. 2, 3, and 4 illustrate the mandrel 14 as being a single, unitary piece. However, it should be appreciated that the mandrel may also be comprised of multiple pieces such that the housing inductive coupler 24 is located in a different piece than the mandrel inductive coupler 26.

One example of assembling the inductive coupling system 10 may be by having the mandrel 14 comprise more than one pipe section, as shown in FIG. 2. The communication probe 20 would initially be separate from the communications port 18 and the mandrel electronics system 16 before the pipe sections were connected. The "lower" portion of the mandrel 14 could be resting in slips on the drill floor of the drilling rig. The various individual or combinations of BHA items that go between a Hang Off Sub or Hang Off Collar may then be picked up and screwed on to the BHA and run into the hole sequentially to make up the BHA. When the Hang Off Sub or Hang Off Collar is picked up, the mandrel electronics system portion of the mandrel 14 that includes the mandrel electronics system 16 and the communications port 18 on the very "bottom" is ready to be picked up. This mandrel electronics system 16 mandrel section is lowered into the collar such that the length of the mandrel electronics system 16 and the length of the collars allows for the communications port 18 to overlap the communication probe 20 to allow for inductive electromagnetic coupling between the two.

The communications port 18 may also act as a stand alone wet connect that can be used on other tools that might have a communication probe 20 such as permanently installed tools in wells where one runs a wireline down the well with the communications port 18 to communicate with and/or power the sensors and actuating devices such as valves. It should be appreciated that either the "male" or "female" ends may be installed in a well bore and be used with the other mating half to make the connection.

The communication probe 20 and the communicating port 18 thus facilitate communication across the tool joint and are not integral with the tool joint itself using a wet connectable connection. The communicating probe 20 and the communications port 18 are also decoupled from the drilling forces required to drill the well, allowing the tool joint to be constructed without deviation from preferred design standards and specifications and without special and potentially costly modifications which may render the tool joint incompatible with industry standards. The connection is also impervious to shorting due to the presence of conductive fluids, i.e., it can be made up even if submersed in fluids. Having a reliable connection in a wet environment allows the changing hang off subs or other BHA items without having to adjust for a few inches in variance.

The inductive coupling system 10 operation involves the communication of an electric signal between the mandrel electronics system 16 and the housing electronics system 36 through the mandrel inductive coupler 26 and the housing inductive coupler 24. The electric signal may be used to transmit data and/or power bi-directionally between the components. An electric signal may be transmitted and received by both the mandrel electronics system 16 and the electronics system 36, allowing for simplex (in either direction), half duplex, or full-duplex communication. For example, operating commands for the RST system may be telemetered from the surface and received by the mandrel electronics system 16. The commands may then be sent from the mandrel electronics system 16 to the housing electronics system 36 for operation of the RST system. In addition or alternatively to operating commands, drilling operation condition data such as hole depth, rate of penetration, formation survey data, as well as other operating condition data may be sent to the housing electronics system 36. The housing electronics system 36 may also telemeter data from the RST system to the mandrel electronics system 16, and from there to the surface using the telemetry system. It should be appreciated that other types of data and/or power telemetry/receiving may be performed. It should also be appreciated that the inductive coupling system may be used for other application than the RST system described.

The example discussed below will be in reference to transmitting data from the electronics system 36 to the mandrel electronics system 16. During operation, the electronics system 36 gathers data from various sensors regarding the status of the outer housing 12, formation sensor readings, borehole orientation measurements, and other downhole measurements. The electronics system 36 then converts that data into an electric signal and transmits that electric signal to the outer housing coil 28. The current in the outer coil 28 from the electric signal creates electromagnetic radiation that propagates through the inner sleeve 22 and to the housing inner coil 30 on the mandrel 14. The housing inner coil 30 acts as a receiving antenna and converts the electromagnetic radiation into an electric signal on the output of the housing inner coil 30 of the housing inductive coupler 24.

From the housing inner coil 30, the electric signal leaves the housing inner coil 30 and propagates up the suitable electric conduit through the communications probe 20 to the probe coil 34. The probe coil 34 again radiates the electromagnetic signal, which is inductively coupled into the mandrel coil 32 of the mandrel inductive coupler 26. The electric signal leaves the mandrel coil 32 and propagates up the suitable electric conduit through the communications port 18 to the mandrel electronics system 16. At the mandrel electronics system 16, the electric signal may be processed and/or, if needed, telemetered to the surface using the telemetry system of the mandrel electronics system 16. On surface, the telemetered data is received and, if needed, converted back into electric signals that are again converted into meaningful data for further use by the personnel on surface. Similarly the inductive coupling system 10 works in the reverse direction passing data, commands, and/or power from any electronics capable of communicating on the transmission path, such as an electronics module, a sensor, a telemetry device, a telemetry repeater, and/or the surface computer to the outer housing 12. Commands sent to the RST over the transmission path can include a target toolface setting, a target inclination setting, a target azimuth setting, a target geo-physical sensor value, tool bore hole position information such as depth, total vertical depth and position within the earth, requests for data such as current toolface inclination, azimuth, geo-physical sensor values, diagnostic information, time, and/or relative time.

The inductive coupling system 10 may be used for transmitting or receiving any suitable type of information. For example the inductive coupling system may be used to transmit and/or receive the following information: (1) bit inclination data or inclination measurement data; (2) sensor quality factors such as the geometric mean of the 2 and/or 3 accelerometer sensors ($G_{total}$); (3) RST status—shaft motor error, drilling programmed mode, battery error, power reset, and housing roll; (4) actual toolface position; and/or (5) target toolface position. Other data may also be transmitted and/or received using the inductive coupling system 10. For example, formation sensor data including resistivity, natural gamma ray, density, acoustic wave propagation measurements, seismic measurements. Drilling performance data can also be sent and/or received across the transmission line such as annular and/or drillpipe pressure, shaft RPM, housing roll rate, azimuthal direction measurement of borehole, vibration and temperature measurements. The electric signal may also include alternating current, electrical power, or unipolar current. The electric signal may also be transmitted in any suitable form. For example, the electric signal may be in the form of at least one of a square wave, sinusoidal wave, trapezoid wave, sawtooth wave, triangle wave, and/or any combination of two or more wave patterns of frequencies, recognizing that zero Hz is considered a frequency in this description. The electric signal may also be modulated using any appropriate scheme. For example, the modulation may be frequency modulation, amplitude modulation, phase modulation, frequency shift keying, chirping, and/or directly driving the binary signal onto the transmission path.

The following is an example of the electronics that may be suitable for the operation of the inductive coupling system 10. It should be appreciated that other electronics may also be used. The housing electronics system 36 may include an RST Processor Electronics Board and a Lower Communication End Point, or otherwise called a Lower Coupler Board. Above the mandrel inductive coupler 26, there may also be an Upper Communications End Point, or otherwise called an Upper Coupler Board. There may also be a Translator Board, a MWD Communications Bus, and a MWD Processor Board-Pressure Case Directional (PCD). The end points in the electronics data exchange path are the RST housing processor board and the MWD PCD processor board. The system would thus be designed for half-duplex operation. However, with some minor changes it could be converted to a full duplex system by those skilled in the art. One could easily implement a full duplex system using several bi-directional techniques including dividing up the available band pass frequency spectrum into at least 2 channels. One channel going to the RST tool, which could be of lesser bandwidth, and one channel going from the RST to the DWD, which could be of a large bandwidth to allow more data to go up than to go down, which is generally what is needed, for example. Obviously, any combination of bandwidth channel size is possible and number of channels is possible. As stated in this implementation only 1 channel is used in half duplex for both directions.

Figure 5:
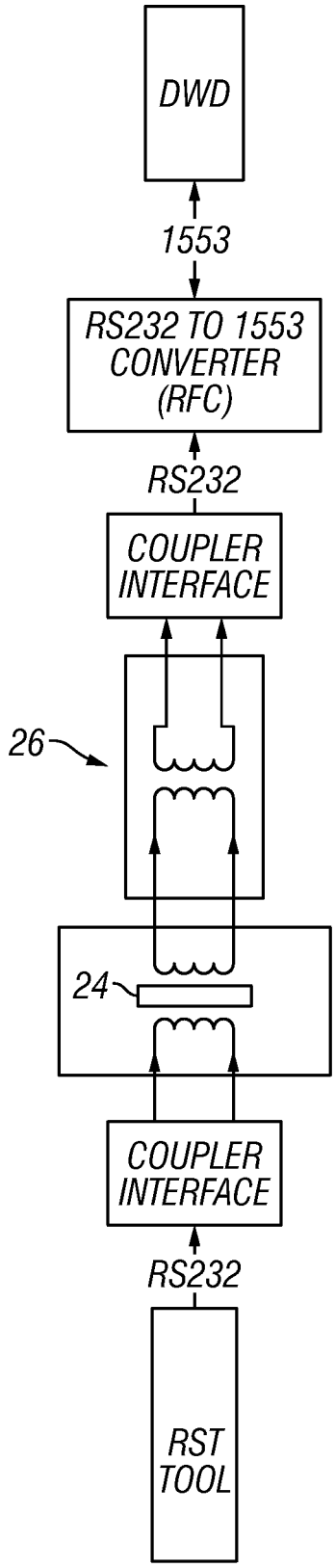
FIG. 5 is a model system diagram of an example electronics system for the inductive coupling system.
Figure 6:
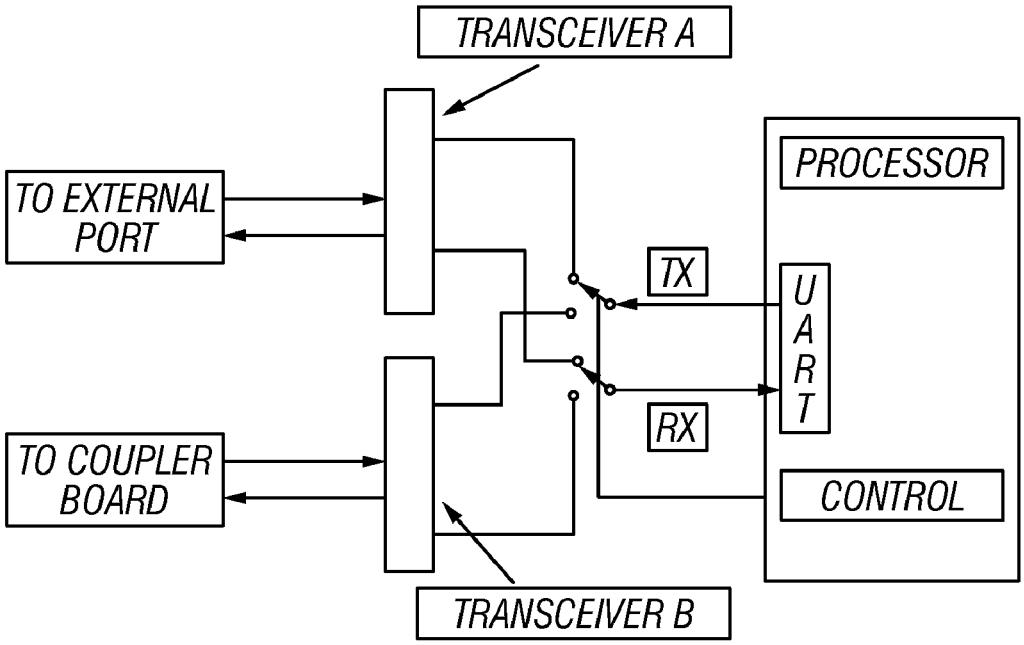
FIG. 6 is a flow diagram showing the operational algorithm of the example electronics system.
Figure 6:
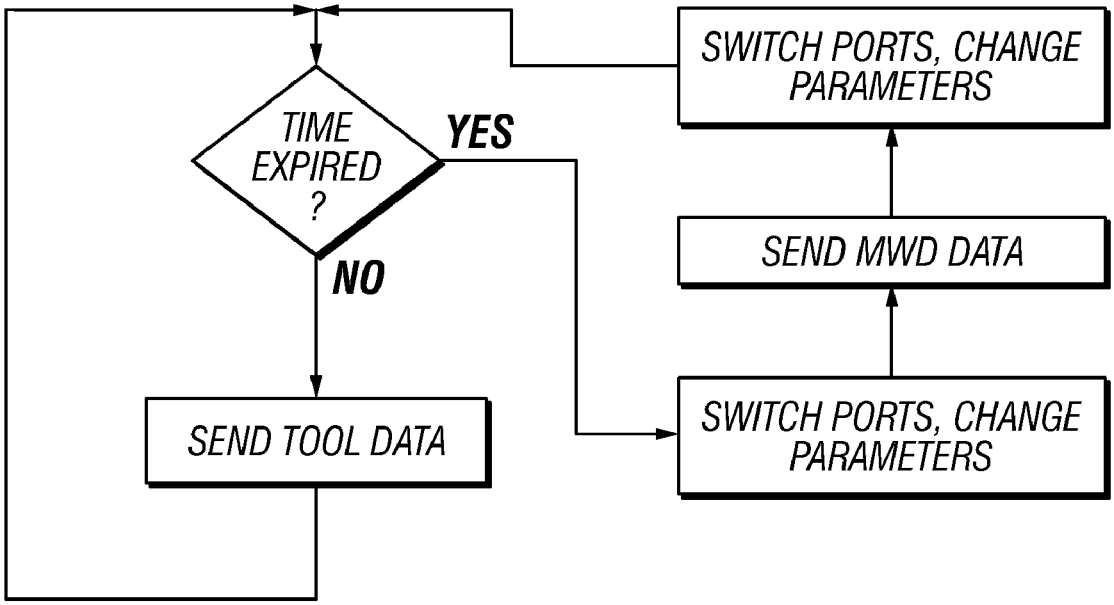

Referring now to FIGS. 5 and 6, a basic system level layout of the electrical model of the transmission system is illustrated. Starting with the RST at the bottom, the RST contains a processor board that is located in a sealed sonde in the outer housing 12. The processor arbitrates between the normal external communications channel (Transceiver A) and the internal communications channel to the inter-tool coupler (Transceiver B). The processor first configures the Universal Asynchronous Receiver Transmitter ("UART") to properly accommodate the output communications parameters for the communications channel that exits the tool via a pressure sealed electrical port. Internally, a user configurable timer runs and upon expiration reconfigures the UART parameters to accommodate communication with the Coupler Board via another communications channel that is connected to the lower Coupler Board Selection of the output channel is controlled by internal logic programmed into the processor. It sends the number of bytes required in a logic level RS232 format and then reverts to the previous channel and parameters. This allows the user the least interruption in normal communication with the tool during surface configuration and data downloading while still providing timely data to the MWD system.

The upper and lower coupler boards are electrically the same and both act as a transceiver for communicating over the transmission line. The coupler board converts the RS232 signal into a pulse amplitude modulation signal (PAM) meaning that the binary data is represented by the presence or absence or a single carrier frequency. In this case a logic 1 is indicated by a 3 kHz carrier and a logic 0 is indicated by no carrier. This would also work with a logic 0 having the carrier on and logic 1 not having a carrier. Additionally other forms of modulation that would work include frequency shift keying where both the logic 1 and the logic 0 each have a different frequency that they transmit. Finally, there are numerous other modulation methods for transmission that are well know by those skilled in the art such as amplitude modulation, phase shift keying, trellis encoding, etc.

After the leaving the lower coupler board, the PAM signal reaches the housing outer coil 28. The alternating current in the housing outer coil 28 from the PAM signal creates electromagnetic radiation that propagates through the inner sleeve 22 and to the housing inner coil 30 on the mandrel 14. Here the housing inner coil 30 acts as a receiving antenna and converts the electromagnetic radiation into an electric signal on the output of the housing inner coil 30 of the housing inductive coupler 24.

From here the PAM signal leaves the housing inner coil 30 and propagates up the suitable electric conduit to the probe coil 34 of the mandrel inductive coupler 26. The probe coil 34 again radiates the electromagnetic signal that is inductively coupled into the mandrel coil 32. The electric signal leaves the mandrel coil 32 and propagates up the suitable electric conduit through the communications port 18 to the upper coupler board where the PAM signal is demodulated back down into and RS232 signal. From here the RS232 signal is fed into a UART on the converter (Translator) board that converts the RS232 signal to a Manchester 1553 signal for communication with the mandrel electronics system 16. In this case, the mandrel electronics system 16 polls the Translator board with request commands for data over the 1553 communications path periodically for new data and sends the data to the telemetry system for transmission to the surface, in this case a mud pulse telemetry system. In this implementation the Translator board has a processor and memory on it to facilitate the function. The translator board also acts as the master for the bus communications between the RST and itself sending data request commands back over the transmission line in the exact opposite path that signals flowed to reach it. In other words the signal flow across the coupler/transmission line works in both directions. On surface the mud pulses are converted back into electric signals which are again converted into meaningful data for further use by the personnel on surface.

Figure 7:
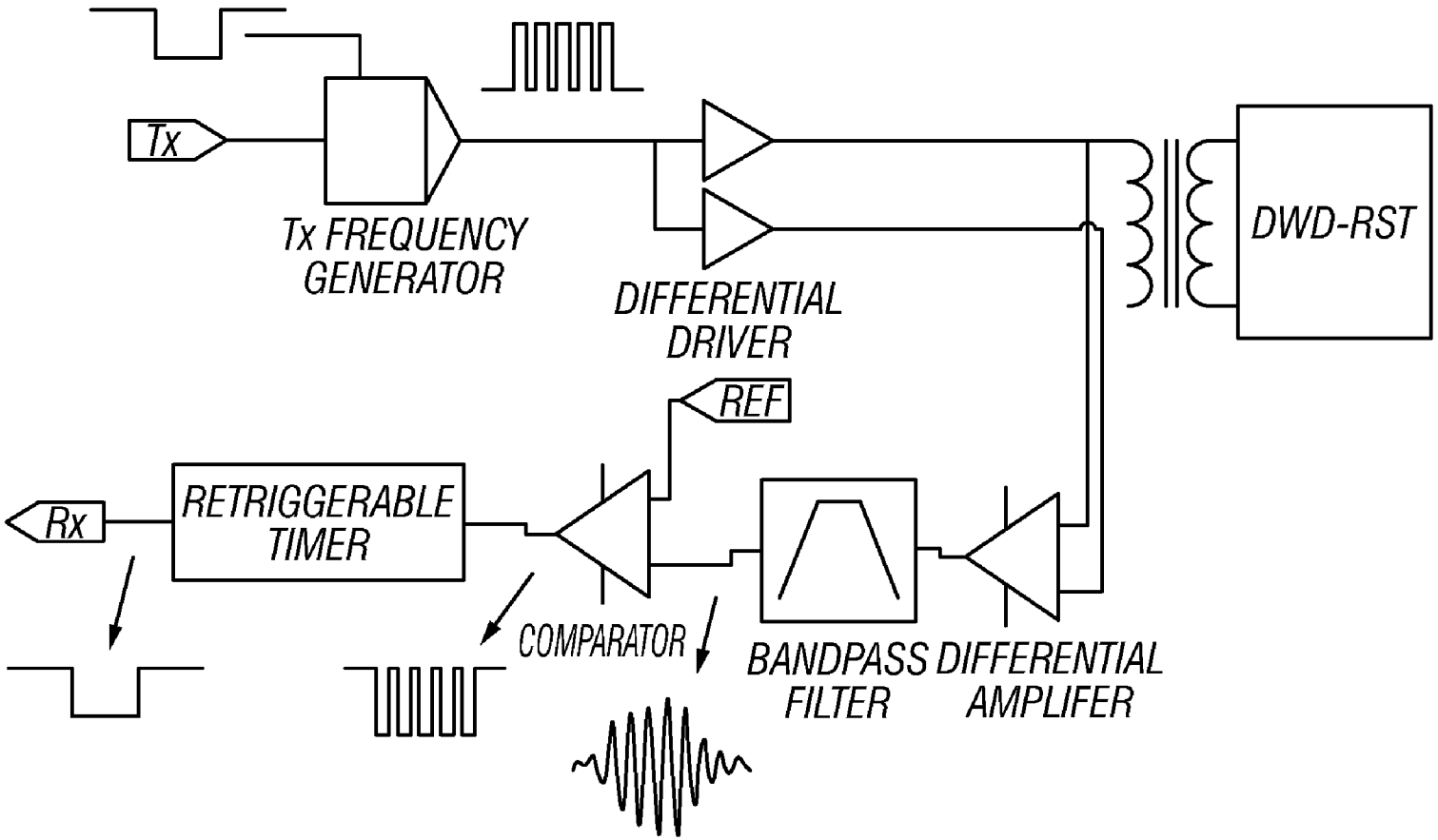
FIG. 7 is a coupler interface board signal flow diagram for the example electronics system.

FIG. 7 explains in more detail how the coupler board works. Starting with the input side (TX), an RS232 signal is fed into one line of a frequency generator. This creates a pulsed amplitude signal for as long as the RS232 Tx logic level remains low. From here the signal is passed to a differential driver that essentially boosts the power of the signal that is driving into the transmission line, here represented by a transformer. Not shown but on the other side of the transformer is the exact same circuit but mirrored to match the function of this one.

When a signal comes into this lower coupler board over the transmission line the lower coupler must not be transmitting or it will interfere with the incoming signal because it is configured for half duplex communication. When the incoming signal arrives it is routed to a differential amplifier to boost the signal strength and into a band pass filter. The output of the band pass filter is fed into a comparator. When the signal voltage exceeds the reference voltage the comparator goes high resulting in a square wave output as the weaker analog signal rises and falls above and below the comparison voltage level.

This square wave output is feed into a retriggerable timer. The timer is set to a known value that is 1.5 to 3 times the width of the carrier cycle period. This means that the carrier frequency resets the timer on every cycle. While the timer is counting down the output of the timer will represent logic 0 in RS232. When there is an absence of the carrier out of the comparator the timer will time out returning to a logic 1 after 1.5 to 3 times the width of the carrier wave period. While 1.5× to 3× the carrier period was selected just about any value greater than or equal to ½ the period will work so long as the on time does not linger outside the tolerances of the RS232 bit width the UART can handle.

Figure 8:
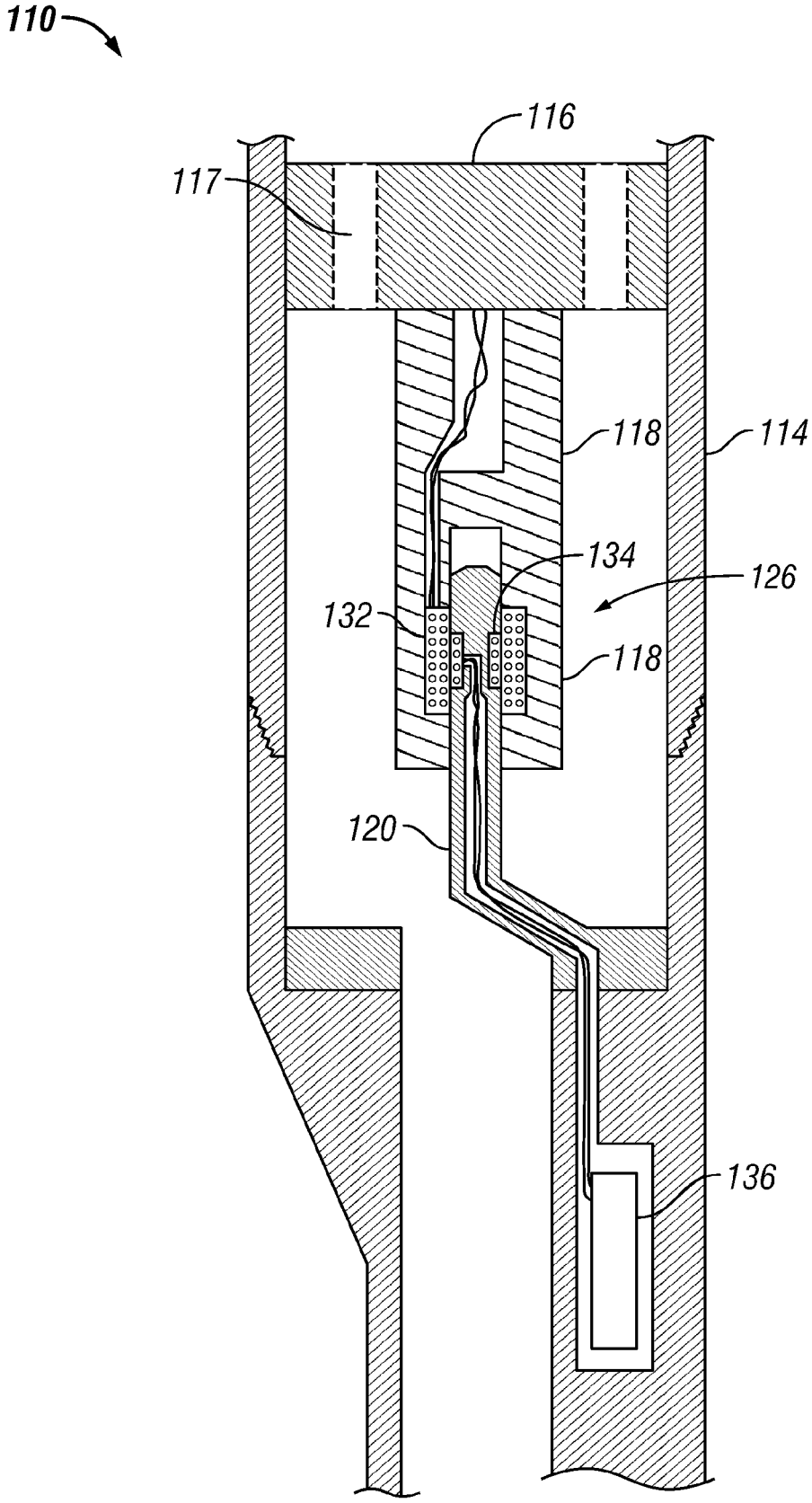
FIG. 8 is a cross section of an alternative embodiment of an inductive coupling system.

FIG. 8 illustrates an alternative embodiment electromagnetic inductive coupling system 110 for a mandrel 114 that has a wall and an inner bore. For example, as illustrated in this embodiment, the mandrel 114 may be a portion of a drill string. As illustrated, the mandrel 114 is in the form of a portion of a drill string used in a wellbore, and may itself comprise multiple pipe sections. As such, attached at the lower end of the mandrel 114 may be a drill bit for boring into a formation. However, other applications for rotating mandrels are within the scope of this system. Located within the inner bore of the mandrel 114 is a first mandrel electronics system 116. The first mandrel electronics system 116 may be any electronics system, for example a communications device and/or a power source or load. The first mandrel electronics system 116 may also include a telemetry/receiver system that may either be a stand-alone system or incorporated into a MWD system. Examples of telemetry/receiver systems include, but are not limited to, wireline systems, steering tool systems, electromagnetic systems, e-line systems for pipe or coiled tubing, acoustic systems, so-called "wired pipe" systems where electric conduits are located in the wall of the drill string, casing, or liner such as INTELLIPIPE® by GRANT PRIDECO™, and mud-pulse systems where the fluid pressure in the borehole is modulated to transmit and receive data. The first mandrel electronics system 116 further includes ports 117 allowing the flow of drilling fluid in the inner bore of the mandrel 114 through the first mandrel electronics system 116. If the first mandrel electronics system 116 is incorporated into a MWD system, the MWD system may comprise any suitable tools for measuring various data while drilling. Examples include sensors for measuring porosity and resistivity of the formation being drilled through. Other sensors may measure the status of the mandrel 114 or performance operations of the drilling process. The first mandrel electronics system 116 also includes a communications port 118 extending into the inner bore of the mandrel 114.

The inductive coupling system 110 also includes a communication probe 120 extending from the wall of the mandrel 114 into the mandrel inner bore. As illustrated, the communication probe 120 is separate from the mandrel 114 and attached by any suitable means such as a threaded connection. However, the communication probe 120 may also be made integral with the mandrel 114.

The inductive coupling system 10 further includes a second mandrel electronics system 136. The second mandrel electronics system 136 may be any electronics system, for example a communications device and/or a power source or load. For example, the second mandrel electronics system may a processor board for processing data received from various downhole sensors.

The inductive coupling system 110 also includes a mandrel inductive coupler 126. The mandrel inductive coupler 126 includes a mandrel coil 132 that is a solenoid wound inductive coil located in the communications port 118 of the first mandrel electronics system 116. The mandrel coil 132 is in electric communication with the first mandrel electronics system 116 through suitable electric conduits running through the communications port 118. The mandrel inductive coupler 126 also includes a probe coil 134 that is a solenoid wound inductive coil located in the communication probe 120. Additionally, the probe coil 134 is in electric communication with the second mandrel electronics system 136 through suitable electric conduits that run through the communication probe 118 and the wall of the mandrel 114. The communications port 118 and communication probe 120 may be made out of any suitable material. However, to increase the strength or power of the communication through the mandrel inductive coupler 126, either or both the communications port 118 and communication probe 120 may be made out of a ferrous material.

The mandrel inductive coupler 126 may also be alternatively configured. As illustrated in FIG. 8, the mandrel coil 132 is longer than the probe coil 134. This allows inductive communication through the mandrel inductive coupler 126 without requiring a precision match up of the location of the mandrel coil 132 with respect to the probe coil 134 upon the assembly of the inductive coupling system 110 by inserting the communication probe 120 into the communications port 118. However, it should also be appreciated that the probe coil 134 may be longer than the mandrel coil 132. It should also be appreciated that the mandrel coil 132 and probe coil 134 may be of equal length. It should also be noted that even if the mandrel coil 132 and probe coil 134 are of equal length, they need not match up exactly upon full assembly to allow the inductive coupling assembly 110 to operate. Thus, some "play" is allowed for cut backs and tape measurement tolerances. Although FIG. 8 illustrates the communications port 118 as being an open-ended, or "female" connector and the communications probe 120 as being a closed, or "male" connector. However, it should be appreciated that the male/female communication may be reversed such that the communications probe 120 would be the "female" connector and the communications port 118 would be the "male" connector.

FIG. 8 illustrates the mandrel 14 as being made up of multiple sections with the first mandrel electronics system 116 being located in a different section than the second mandrel electronics system 136. However, it should be appreciated that the mandrel 114 may also be a single, unitary piece, or that the first mandrel electronics system 116 may be located in the same section as the second mandrel electronics system 136.

One example of assembling the inductive coupling system 110 may be by having the mandrel 114 comprise more than one pipe section, as shown in FIG. 8. The communication probe 120 would initially be separate from the communications port 118 and the first mandrel electronics system 116 before the pipe sections were connected. The "lower" portion of the mandrel 114 could be resting in slips on the drill floor of the drilling rig. The various individual or combinations of BHA items that go between a Hang Off Sub or Hang Off Collar may then be picked up and screwed on to the BHA and run into the hole sequentially to make up the BHA. When the Hang Off Sub or Hang Off Collar is picked up, the first mandrel electronics system portion of the mandrel 114 that includes the first mandrel electronics system 116 and the communications port 118 on the very "bottom" is ready to be picked up. This first mandrel electronics system 116 mandrel section is lowered into the collar such that the length of the first mandrel electronics system 116 and the length of the collars allows for the communications port 118 to overlap the communication probe 120 to allow for inductive electromagnetic coupling between the two.

The communications port 118 may also act as a stand alone wet connect that can be used on other tools that might have a communication probe 120 such as permanently installed tools in wells where one runs a wireline down the well with the communications port 118 to communicate with and/or power the sensors and actuating devices such as valves. It should be appreciated that either the "male" or "female" ends may be installed in a well bore and be used with the other mating half to make the connection.

The communication probe 120 and the communications port 118 thus facilitate communication across the tool joint and are not integral with the tool joint itself using a wet connectable connection. The communication probe 120 and the communications port 118 are also decoupled from the drilling forces required to drill the well, allowing the tool joint to be constructed without deviation from preferred design standards and specifications and without special and potentially costly modifications which may render the tool joint incompatible with industry standards. The connection is also impervious to shorting due to the presence of conductive fluids, i.e., it can be made up even if submersed in fluids. Having a reliable connection in a wet environment allows the changing hang off subs or other BHA items without having to adjust for a few inches in variance.

The inductive coupling system 110 operation involves the communication of an electric signal between the first mandrel electronics system 116 and the second mandrel electronics system 136 through the mandrel inductive coupler 126. The electric signal may be used to transmit data and/or power bi-directionally between the components. An electric signal may be transmitted and received by both the first mandrel electronics system 116 and the second mandrel electronics system 136, allowing for simplex (in either direction), half duplex, or full-duplex communication. For example, data may be telemetered from the surface and received by the first mandrel electronics system 116. The data may then be sent from the first mandrel electronics system 116 to the second mandrel electronics system 136 via the mandrel inductive coupler 126. As examples, the data may include drilling operation condition data such as hole depth, rate of penetration, formation survey data, as well as other operating condition data or commands to any downhole tools. The second mandrel electronics system 136 may also telemeter data to the first mandrel electronics system 116, and from there to the surface using the telemetry system. It should be appreciated that other types of data and/or power telemetry/receiving may be performed. It should also be appreciated that the inductive coupling system 110 may be used for other applications than the system described.

The example discussed below will be in reference to transmitting data from the second mandrel electronics system 36 to the first mandrel electronics system 116. During operation, the second mandrel electronics system 36 may gather data from various sensors regarding the status of the mandrel 114, formation sensor readings, borehole orientation measurements, and other downhole measurements. The second mandrel electronics system 36 then converts that data into an electric signal and transmits that electric signal to the probe coil 134 through the communications probe 120. The probe coil 134 radiates the electromagnetic signal, which is inductively coupled into the mandrel coil 132 of the mandrel inductive coupler 126. The electric signal leaves the mandrel coil 132 and propagates up the suitable electric conduit through the communications port 118 to the first mandrel electronics system 116. At the first mandrel electronics system 116, the electric signal may be processed and/or, if needed, telemetered to the surface using the telemetry system of the first mandrel electronics system 116. On surface, the telemetered data is received and if needed, converted back into electric signals that are again converted into meaningful data for further use by the personnel on surface. Similarly the inductive coupling system 110 works in the reverse direction passing data, commands, and/or power from any electronics capable of communicating on the transmission path, such as an electronics module, a sensor, a telemetry device, a telemetry repeater, and/or the surface computer to the second mandrel electronics system 136. Commands sent over the transmission path can include a target toolface setting, a target inclination setting, a target azimuth setting, a target geo-physical sensor value, tool bore hole position information such as depth, total vertical depth and position within the earth, requests for data such as current inclination, azimuth, geo-physical sensor values, diagnostic information, time, and/or relative time.

The inductive coupling system 110 may be used for transmitting or receiving any suitable type of information. For example, the inductive coupling system 110 may be used to transmit and/or receive the following information: (1) bit inclination data or inclination measurement data; (2) sensor quality factors such as the geometric mean of the 2 and/or 3 accelerometer sensors ($G_{total}$); (3) RST status—shaft motor error, drilling programmed mode, battery error, power reset, and housing roll; (4) actual toolface position; and/or (5) target toolface position. Other data may also be transmitted and/or received using the inductive coupling system 110. For example, formation sensor data including resistivity, natural gamma ray, density, acoustic wave propagation measurements, seismic measurements. Drilling performance data can also be sent and/or received across the transmission line such as annular and/or drillpipe pressure, shaft RPM, azimuthal direction measurement of borehole, vibration and temperature measurements. The electric signal may also include alternating current, electrical power, or unipolar current. The electric signal may also be transmitted in any suitable form. For example, the electric signal may be in the form of at least one of a square wave, sinusoidal wave, trapezoid wave, sawtooth wave, triangle wave, and/or any combination of two or more wave patterns of frequencies, recognizing that zero Hz is considered a frequency in this description. The electric signal may also be modulated using any appropriate scheme. For example, the modulation may be frequency modulation, amplitude modulation, phase modulation, frequency shift keying, chirping, and/or directly driving the binary signal onto the transmission path.

Figure 9:
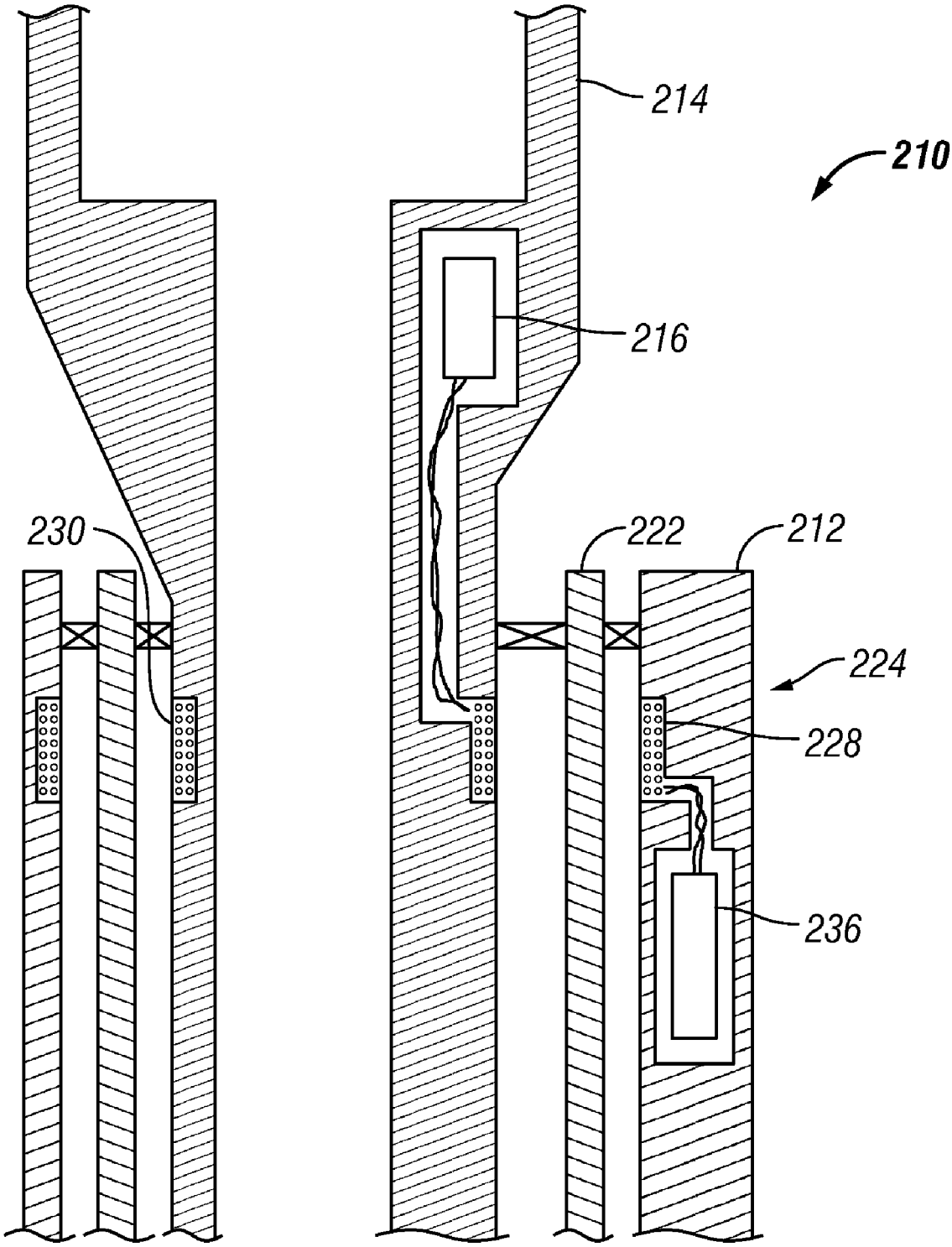
FIG. 9 is a cross section of a second alternative embodiment of an inductive coupling system.

FIG. 9 illustrates a second alternative embodiment electromagnetic inductive coupling system 210 for a mandrel 214 that has a wall and an inner bore. For example, as illustrated in this embodiment, the mandrel 214 may be part of the RST system described with reference to FIG. 1. The inductive coupling system 210 also includes an inner sleeve 222 and an outer housing 212. As illustrated, the mandrel 214 is in the form of a portion of a drill string used in a wellbore, and may itself comprise multiple pipe sections. As such, attached at the lower end of the mandrel 214 is a drill bit for boring into a formation. However, other applications for rotating mandrels are within the scope of this system. Located within the mandrel 214 is a mandrel electronics system 216. The mandrel electronics system 216 may be any electronics system, for example a communications device and/or a power source or load. The mandrel electronics system 216 may also include a telemetry/receiver system that may either be a stand-alone system or incorporated into a MWD system. Examples of telemetry/receiver systems include, but are not limited to, wireline systems, steering tool systems, electromagnetic systems, e-line systems for pipe or coiled tubing, acoustic systems, so-called "wired pipe" systems where electric conduits are located in the wall of the drill string, casing, or liner such as the INTELLPIPE® by GRANT PRIDECO™, or wired composite pipe as such as the ANACONDA® by HALLIBURTON™, and mud-pulse systems where the fluid pressure in the borehole is modulated to transmit and receive data. If the mandrel electronics system 216 is incorporated into a MWD system, the MWD system may comprise any suitable tools for measuring various data while drilling. Examples include sensors for measuring porosity and resistivity of the formation being drilled through. Other sensors may measure the status of the mandrel 214 or performance operations of the drilling process.

As illustrated in FIG. 9, the inductive coupling system 210 includes an inner sleeve 222 including a bore surrounding at least a portion of the mandrel 214. FIG. 9 illustrates the mandrel 214 as being a single, unitary piece. However, it should be appreciated that the mandrel 214 may also be comprised of multiple sections. The inner sleeve 222 is rotatable relative to the mandrel 214. As an example, the inner sleeve 222 may rotate on bearings between the mandrel 214 and the inner sleeve 222. As an alternative, the inner sleeve bore may be eccentrically positioned with respect to the rotational axis of the mandrel 214. It should also be appreciated, however, that the inner sleeve 222 need not rotate with respect to the mandrel 214 during operation of the inductive coupling system 210. As illustrated in FIG. 9, there is a gap between the inner sleeve 222 and the mandrel 214. This space may be occupied by conductive or non-conductive fluids, a gas, or a vacuum of essentially empty space.

The inductive coupling system 210 also includes an outer housing 212 that includes a bore surrounding at least a portion of the inner sleeve 222. The outer housing 212 is rotatable relative to the inner sleeve 222 and thus also the mandrel 214. As an example, the outer housing 212 may rotate on bearings between the outer housing 212 and the inner sleeve 222. As an alternative, the outer housing bore may be eccentric with respect to the rotational axis of the mandrel 214. It should also be appreciated, however, that the outer housing 212 need not rotate with respect to the mandrel 214 during operation of the inductive coupling system 10. As illustrated in FIG. 9, there is a gap between the outer housing 212 and the inner sleeve 222. This space may be occupied by conductive or non-conductive fluids, a gas, or a vacuum of essentially empty space.

The inductive coupling system 210 also includes a housing inductive coupler 224. The housing inductive coupler 224 includes a housing outer coil 228 that is a solenoid wound inductive coil located in and moving with the outer housing 212. The housing outer coil 228 is in electric communication with the housing electronics system 236. The housing inductive coupler 224 also include a housing inner coil 230 that is a solenoid wound inductive coil located in and moving with the mandrel 214. The housing inner coil 230 is in electric communication with the mandrel electronics system 216. As illustrated in FIG. 9, the inner sleeve 222 is located between the housing inner coil 230 and the housing outer coil 228. The inner sleeve 222 may be of any suitable material that would allow the electromagnetic communication between the housing outer coil 228 and the housing inner coil 230. For example, the inner sleeve 222 may be made of metal, even though some attenuation of the electro-magnetic field communicated between the housing outer coil 228 and the housing inner coil 230 may occur. The inner sleeve 222 may also be non-conductive, such as composite tubing or various plastics. Additionally, either of or both of the inner sleeve 222 and the outer housing 212 may have eccentric bores with respect to the mandrel 214. If so, the radial distance between the housing outer coil 228 and the housing inner coil 230 in a plane will vary with the rotational orientation of the inner sleeve 222 and outer housing 212 with respect to the mandrel. Additionally, the housing outer coil 228 is in electric communication with a housing electronics system 236 located in the wall of the outer housing 212 though suitable electric conduits running through the wall of the outer housing 212. For example, the conduits may be electrical wiring that may be insulated or potted for protection. Additionally, the housing electronics system 236 may also further be connected to other electronics systems or sensors in other parts of the mandrel 214. Additionally, the inductive coils may be located in sleeves separate from the mandrel 214 and the outer housing 212.

The inductive coupling system 210 operation involves the communication of an electric signal between the mandrel electronics system 216 and the housing electronics system 236 though the housing inductive coupler 224. The electric signal may be used to transmit data and/or power bi-directionally between the components. An electric signal may be transmitted and received by both the mandrel electronics system 216 and the housing electronics system 236, allowing for simplex (in either direction), half duplex, or full-duplex communication. For example, operating commands for the RST system may be telemetered from the surface and received by the mandrel electronics system 216. The commands may then be sent from the mandrel electronics system 216 to the housing electronics system 236 for operation of the RST system. In addition or alternatively to operating commands, drilling operation condition data such as hole depth, rate of penetration, formation survey data, as well as other operating condition data may be sent to the housing electronics system 236. The housing electronics system 236 may also telemeter data from the RST system to the mandrel electronics system 216, and from there to the surface. It should be appreciated that other types of data and/or power telemetry/receiving may be performed. It should also be appreciated that the inductive coupling system may be used for other applications than the RST system described.

The example discussed below will be in reference to transmitting data from the housing electronics system 236 to the mandrel electronics system 216. During operation, the housing electronics system 236 gathers data from various sensors regarding the status of the outer housing 212, formation sensor readings, borehole orientation measurements, and other downhole measurements. The housing electronics system 236 then converts that data into an electric signal and transmits that electric signal to the outer housing coil 228. The current in the outer housing coil 228 from the electric signal creates electromagnetic radiation that propagates through the inner sleeve 222 and to the housing inner coil 230 on the mandrel 214. The housing inner coil 230 acts as a receiving antenna and converts the electromagnetic radiation into an electric signal on the output of the housing inner coil 230 of the housing inductive coupler 224.

From the housing inner coil 230, the electric signal leaves the housing inner coil 230 and propagates up the suitable electric conduit through the communications probe 20 to the probe coil 34. The probe coil 34 again radiates the electromagnetic signal, which is inductively coupled into the mandrel coil 32 of the mandrel inductive coupler 26. The electric signal leaves the mandrel coil 32 and propagates up the suitable electric conduit through the communications port 18 to the mandrel electronics system 216. At the mandrel electronics system 216, the electric signal may be processed and/or, if needed, telemetered to the surface using a telemetry system. On surface, the telemetered data is received and, if needed, converted back into electric signals that are again converted into meaningful data for further use by the personnel on surface. Similarly the inductive coupling system 210 works in the reverse direction passing data, commands, and/or power from any electronics capable of communicating on the transmission path, such as an electronics module, a sensor, a telemetry device, a telemetry repeater, and/or the surface computer to the outer housing 212. Commands sent to the RST over the transmission path can include a target toolface setting, a target inclination setting, a target azimuth setting, a target geo-physical sensor value, tool bore hole position information such as depth, total vertical depth and position within the earth, requests for data such as current toolface inclination, azimuth, geophysical sensor values, diagnostic information, time, and/or relative time.

The inductive coupling system 210 may be used for transmitting or receiving any suitable type of information. For example the inductive coupling system may be used to transmit and/or receive the following information: (1) bit inclination data or inclination measurement data; (2) sensor quality factors such as the geometric mean of the 2 and/or 3 accelerometer sensors ($G_{total}$); (3)RST status—shaft motor error, drilling programmed mode, battery error, power reset, and housing roll; (4) actual toolface position; and/or (5) target toolface position. Other data may also be transmitted and/or received using the inductive coupling system 10. For example, formation sensor data including resistivity, natural gamma ray, density, acoustic wave propagation measurements, seismic measurements. Drilling performance data can also be sent and/or received across the transmission line such as annular and/or drillpipe pressure, shaft RPM, housing roll rate, azimuthal direction measurement of borehole, vibration and temperature measurements. The electric signal may also include alternating current, electrical power, or unipolar current. The electric signal may also be transmitted in any suitable form. For example, the electric signal may be in the form of at least one of a square wave, sinusoidal wave, trapezoid wave, sawtooth wave, triangle wave, and/or any combination of two or more wave patterns of frequencies, recognizing that zero Hz is considered a frequency in this description. The electric signal may also be modulated using any appropriate scheme. For example, the modulation may be frequency modulation, amplitude modulation, phase modulation, frequency shift keying, chirping, and/or directly driving the binary signal onto the transmission path.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An inductive coupling system including:

a mandrel including an inner bore;

an inner sleeve including a bore surrounding at least a portion of the mandrel, the inner sleeve being rotatable relative to the mandrel;

an outer housing including a bore surrounding at least a portion of the inner sleeve, the outer housing being rotatable relative to the inner sleeve;

a mandrel electronics system including a communications port located in the mandrel inner bore;

a housing electronics system located in the outer housing;

a communication probe extending from the wall of the mandrel into the mandrel inner bore;

a housing inductive coupler including a housing outer coil located in and moving with the outer housing and a housing inner coil located in and moving with the mandrel, the inner sleeve located between the housing inner coil and the housing outer coil, the housing outer coil being in electric communication with the housing electronics system; and a mandrel inductive coupler including a mandrel coil located in the communications port and a probe coil located in the communication probe, the mandrel coil being in electric communication with the mandrel electronics system and the probe coil being in electric communication with the housing inner coil through the communication probe.

2. The inductive coupling system of claim 1 wherein the mandrel is a drill string.

3. The inductive coupling system of claim 1 wherein the mandrel coil is longer than the probe coil.

4. The inductive coupling system of claim 1 wherein the communication probe fits within the communications port.

5. The inductive coupling system of claim 1 wherein the radial distance between the housing outer coil and the housing inner coil in a plane varies with the rotational orientation of the inner sleeve and outer housing with respect to the mandrel.

6. The inductive coupling system of claim 1 wherein the housing outer coil and housing inner coil communicate through the inner sleeve.

7. The inductive coupling system of claim 1 wherein the mandrel electronics system includes a telemetry/receiver system selected from the group consisting of a wireline system, a steering tool system, an electromagnetic system, an e-line system, an acoustic system, a wired pipe system, and a mud-pulse system.

8. The inductive coupling system of claim 1 wherein the inner sleeve is metal.

9. The inductive coupling system of claim 1 wherein:

the mandrel is in multiple sections; and the mandrel inductive coupler is in one section of the mandrel and the housing coupler is in another section.

10. A communications method including:

providing a mandrel including an inner bore and a communication probe extending from the wall of the mandrel into the mandrel inner bore;

providing an inner sleeve including a bore surrounding at least a portion of the mandrel, the inner sleeve being rotatable relative to the mandrel;

providing an outer housing including a bore surrounding at least a portion of the inner sleeve, the outer housing being rotatable relative to the inner sleeve;

providing a mandrel electronics system including a communications port located in the mandrel inner bore;

providing a housing electronics system located in the outer housing;

communicating between the housing electronics system and a housing outer coil located in and moving with the outer housing;

electromagnetically communicating between the housing outer coil and a housing inner coil located in and moving with the mandrel, the inner sleeve being located between the housing outer coil and a housing inner coil;

communicating between the housing inner coil and a probe coil located in the communication probe;

electromagnetically communicating between the probe coil and a mandrel coil located in the communications port; and communicating between the mandrel coil and the mandrel electronics system.

11. The method of claim 10 wherein the mandrel is a drill string.

12. The method of claim 11 further comprising drilling a borehole.

13. The method of claim 10 wherein the mandrel coil is longer than the probe coil.

14. The method of claim 10 wherein the communication probe fits within the communications port.

15. The method of claim 10 wherein the radial distance between the housing outer coil and the housing inner coil in a plane varies with the rotational orientation of the inner sleeve and outer housing with respect to the mandrel.

16. The method of claim 10 wherein electromagnetically communicating between the housing outer coil and a housing inner coil further includes electromagnetically communicating through the inner sleeve.

17. The method of claim 10 further including communicating both from the mandrel electronics system to the housing electronics system and from the housing electronics system to the mandrel electronics system.

18. The method of claim 10 wherein communicating and electromagnetically communicating further includes communicating an electrical signal in a form selected from the group consisting of at least one of a zero Hertz signal, a square wave, a sinusoidal wave, a trapezoid wave, a sawtooth wave, and a triangle wave.

19. The method of claim 10 wherein communicating and electromagnetically communicating further includes modulating an electric signal using a modulation scheme selected from the group consisting of frequency modulation, amplitude modulation, phase modulation, frequency shift keying, chirping, and directly driving the binary signal onto the transmission path.

20. The method of claim 10 wherein communicating and electromagnetically communicating includes communicating data selected from the group consisting of including bit inclination data, inclination measurement data, tool faults, errors, orientation, settings, conditions, states, sensor data sensor quality factors, RST status, actual toolface position, target toolface position, formation sensor data, and drilling performance data.

21. The method of claim 10 wherein communicating and electromagnetically communicating further includes modulating an electric signal to transmit alternating current, electric power between the mandrel electronics system and the housing electronics system.

22. An inductive coupling system including:

a mandrel including multiple sections joined together and forming an inner bore;

a first mandrel electronics system located in the mandrel inner bore of a first mandrel section;

a second mandrel electronics system located in a second mandrel section;

a communications port in electric communication with the first mandrel electronics system;

a communication probe extending from the wall of the second mandrel section and into the mandrel inner bore, the communication probe being in electric communication with the second mandrel electronics system;

a mandrel inductive coupler including a mandrel coil located in the communications port and a probe coil located in the communication probe, the mandrel coil being in electric communication with the first mandrel electronics system and the probe coil being in electric communication with the second mandrel electronics system through the communication probe.

23. The inductive coupling system of claim 22 wherein the mandrel sections form a drill string.

24. The inductive coupling system of claim 22 wherein the mandrel coil is longer than the probe coil.

25. The inductive coupling system of claim 22 wherein the communication probe fits within the communications port.

26. The inductive coupling system of claim 1 wherein the mandrel electronics system includes a telemetry/receiver system selected from the group consisting of a wireline system, a steering tool system, an electromagnetic system, an e-line system, an acoustic system, a wired pipe system, and a mud-pulse system.

27. An inductive coupling system including:

a mandrel;

an inner sleeve including a bore surrounding at least a portion of the mandrel, the inner sleeve being rotatable relative to the mandrel;

an outer housing including a bore surrounding at least a portion of the inner sleeve, the outer housing being rotatable relative to the inner sleeve;

a mandrel electronics system located in the mandrel;

a housing electronics system located in the outer housing;

a housing inductive coupler including a housing outer coil located in and moving with the outer housing and a housing inner coil located in and moving with the mandrel, the inner sleeve located between the housing inner coil and the housing outer coil, the housing outer coil being in electric communication with the housing electronics system and the housing inner coil being in electric communication with the mandrel electronics system.

28. The inductive coupling system of claim 27 wherein the mandrel is a drill string.

29. The inductive coupling system of claim 27 wherein the radial distance between the housing outer coil and the housing inner coil in a plane varies with the rotational orientation of the inner sleeve and outer housing with respect to the mandrel.

30. The inductive coupling system of claim 27 wherein the housing outer coil and housing inner coil communicate through the inner sleeve.

31. The inductive coupling system of claim 27 wherein the mandrel electronics system includes a telemetry/receiver system selected from the group consisting of a wireline system, a steering tool system, an electromagnetic system, an e-line system, an acoustic system, a wired pipe system, and a mud-pulse system.

32. The inductive coupling system of claim 27 wherein the inner sleeve is metal.

* * * * *